United States Patent [19]

Rojey et al.

[11] 4,089,186

[45] May 16, 1978

[54] HEATING PROCESS USING A HEAT PUMP AND A FLUID MIXTURE

[75] Inventors: Alexandre Rojey, Boulogne; Georges Cohen, Le Pecq, both of France

[73] Assignee: Institut Francais du Petrole, Rueil-Malmaison, France

[21] Appl. No.: 756,838

[22] Filed: Jan. 5, 1977

[30] Foreign Application Priority Data

Jan. 7, 1976 France ..... 76 00390

[51] Int. Cl.[2] ..... F25B 15/00; F25B 27/02; F25B 1/00

[52] U.S. Cl. ..... 62/101; 62/114; 62/238; 62/502

[58] Field of Search ..... 62/114, 502, 238, 101; 165/1, 2

[56] References Cited

U.S. PATENT DOCUMENTS

| | | | |
|---|---|---|---|
| 2,182,453 | 12/1939 | Sellew | 62/238 |
| 3,578,073 | 5/1971 | Bosquain | 62/114 |
| 3,986,343 | 10/1976 | Ergenc | 62/101 |
| 4,003,213 | 1/1977 | Cox | 62/238 |
| 4,003,798 | 1/1977 | McCord | 62/238 |

*Primary Examiner*—Lloyd L. King
*Attorney, Agent, or Firm*—Millen & White

[57] ABSTRACT

Process for producing heat at a temperature level higher than that of an available heat source comprising vaporizing a working fluid of at least two components of different boiling points by heat exchange with said heat source within a first temperature range, compressing at least a portion of the obtained vapor and condensing at least a portion of the compressed vapor in a temperature range whose highest temperature is higher than the highest temperature of said first range while transferring condensation heat to an external medium other than said heat source, expanding the condensed liquid fraction and using it as said working fluid.

21 Claims, 1 Drawing Figure

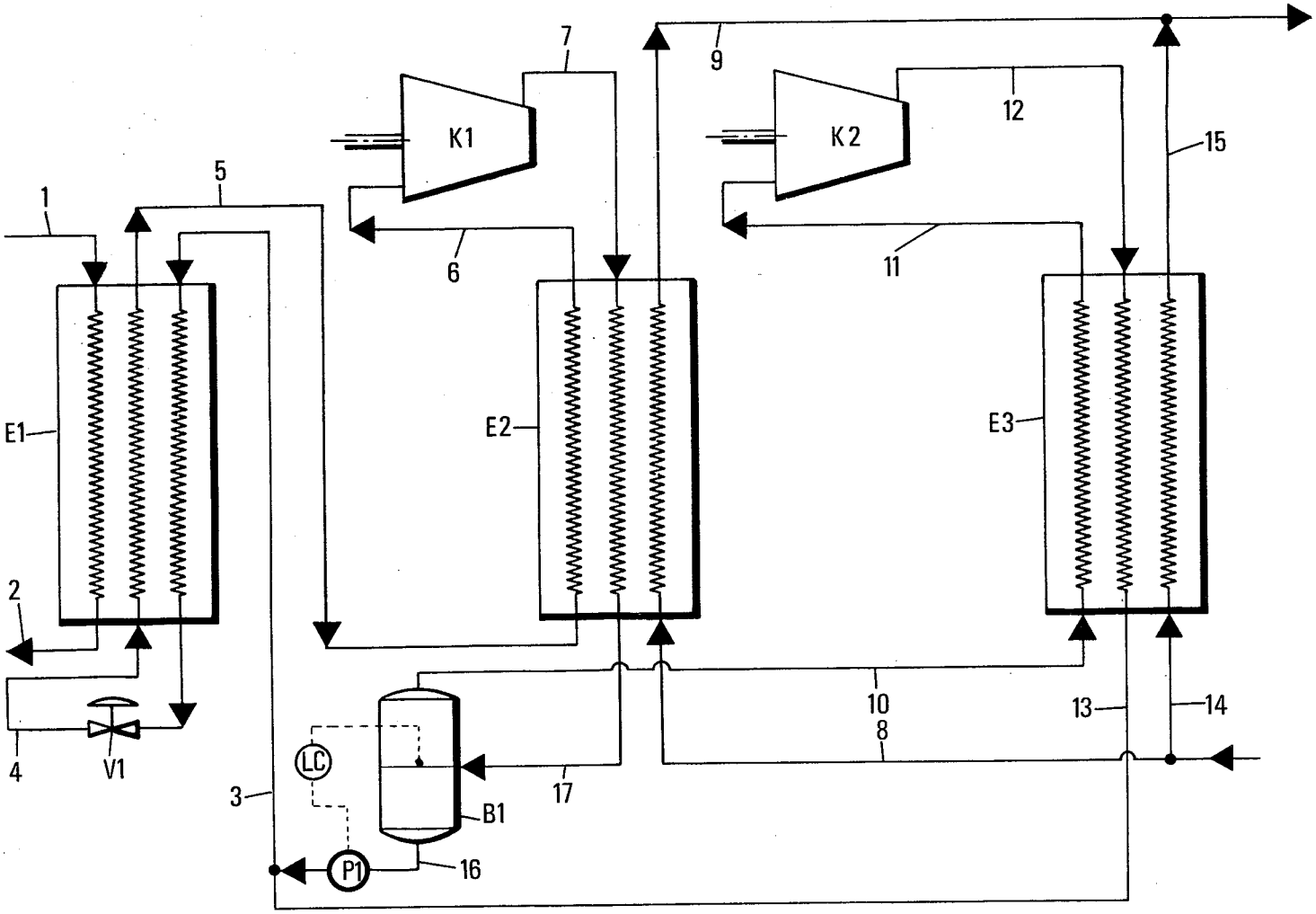
1
2
3
4
5
6
7
8
9
10
11
12
13
14
15
16
17
E1
E2
E3
K1
K2
V1
B1
LC
P1

HEATING PROCESS USING A HEAT PUMP AND A FLUID MIXTURE

Substantial amounts of hot water are available: for example waters which have been used for cooling industrial installations and are discharged therefrom, water withdrawn from geothermal fields at low temperature, or still water heated by solar radiation.

In many cases, the temperature of the hot water is insufficient for its use as heating medium, either for heating houses by radiators or for industrial heating. In these cases, in order to use the heat contained in hot water, it is necessary to increase its temperature level by means of a heat pump.

On the other hand, in order to extract the maximum of heat, it is advantageous to proceed under such conditions that water, after heat exchange, be at the lowest possible temperature. However, if this temperature is too low and since the evaporator of the heat pump which extracts the corresponding heat must be operated at a still lower temperature, the performance coefficient of the heat pump becomes too low. The only solution available, up to now, for improving the performance, consisted of proceeding with two or more sequentially mounted heat pumps, the evaporators of these heat pumps being operated at lower and lower temperature levels, each of these heat pumps being operated with a different fluid and/or at a different pressure level at the evaporator.

It has been discovered, and this is the first object of the invention, that it is advantageous to proceed with a heat pump making use of a conveniently selected mixture of fluids. It has been also discovered that it was advantageous to proceed with several compression stages, particularly when the supplied heat is destined to be used in a relatively narrow range, It is possible, in this case, to vary the thermal power available for use by operating only a fraction of the stages and by adjusting the composition of the mixture passing through the evaporator.

The process for producing heat according to the invention comprises of: vaporizing a mixture of at least two components of different boiling points, called working fluid, which takes off at least the major part of the vaporization heat, countercurrently, from a first external fluid in the temperature range A, inside a heat exchange zone I, compressing at least one portion of the obtained vapor in a compression zone, condensing at least one portion of the compressed vapor, while transferring at least the major portion of the condensation heat, countercurrently, to a second external fluid, inside a heat exchange zone II, within a temperature range B, the highest temperature of temperature range B being then higher than the highest temperature of the temperature range A, withdrawing at least a portion of the obtained liquid fraction, expanding it through an expansion valve and feeding it back to the heat exchange zone I.

According to a preferred embodiment of the invention, there is provided at least one additional stage mounted in series. When the system provides its full thermal power, after compression of the vapor in the first compression zone, there is condensed a liquid fraction whose average molecular weight is higher than the average molecular weight of the mixture circulating through the evaporator, while transferring heat within the temperature range B, and there is also obtained a vapor fraction lighter than the mixture circulating through the evaporator. This vapor fraction is supplied to a second compression zone, and then, after compression, condensed at least partly in a heat exchange zone III, within a temperature range B'; the so-obtained liquid fraction being admixed with the liquid fraction withdrawn from the heat exchange zone II, the mixture of these two liquid fractions being fed back to the heat exchange zone I.

The second external fluid may be subdivided into two streams which pass respectively through exchanger II and exchanger III and are subsequently readmixed. It is also possible to pass all the external fluid through exchanger III, then through exchanger II or conversely.

It is possible to arrange a third stage in series. In this case, the vapor issued from the second compression zone is only partially condensed and the vapor fraction obtained is supplied to a third compression zone. It is obviously possible to proceed with any number of stages, the vapor fraction compressed in the successive stages being lighter and lighter.

The temperature range A may be, for example, from 0° C to 100° C. The temperature ranges B and B' may be, for example, from 40° C to 130° C. Each temperature range extends preferably over at least 10° C.

Pressure P1, at which the mixture is vaporized, may be, for example, from 1 to 10 atmospheres. Pressure P2, at which condensation of the mixture is completed may be from P1 to, for example, 50 atmospheres. When the condensation is performed in several stages, the intermediate pressures are staggered within the range P1–P2.

The mixture of fluids will be in most cases a mixture of organic compounds miscible with each other in the liquid state.

These organic compounds are, for example, hydrocarbons whose molecule contains from 2 to 6 carbon atoms, or fluorinated or chlorinated hydrocarbons having one or two carbon atoms. Any stable and non-corrosive compound may be convenient, provided that it can be vaporized as a mixture within the temperature range A and can be condensed as a mixture within temperature range B by merely changing the pressure. The mixture must contain at least one component whose critical temperature is at least equal to the highest temperature of temperature range B.

Preferably at least one component of the mixture has a normal boiling temperature higher than 0° C.

The use of a mixture capable of forming an azeotrope is excluded when the mixture has a composition close to that for which it forms said azeotrope at the selected vaporization pressure.

The invention will be illustrated by the following examples:

EXAMPLE 1

Water at 70° C is supplied at a rate of 100m$^3$/h from a geothermal well. It is fed to a second well after transfer of its heat. In order to recover the maximum of heat and to increase the temperature of utilization, there is used a heat pump system diagrammatically shown in FIG. 1.

The water withdrawn from the geothermal well is supplied by duct 1, at a temperature of 70° C, to exchanger E1, wherefrom it is discharged, through duct 2, at a temperature of 20° C. The transferred heat produces vaporization of the working fluid consisting of a mixture whose composition, in molar fractions, is as follows:

40% of dichloro-difluoromethane (R22)

60% of 1,1,2-trichloro-1,2,2-trifluoro-ethane (R 113).

This mixture forms no azeotrope within the working range.

There is circulated, through exchanger E1, 157 metric tons per hour of the mixture (157 mT/h). This mixture is supplied, in the liquid state, from duct 3 to exchanger E1 at a temperature of 70° C and a pressure of 16 atmospheres. It is sub-cooled, down to a temperature of about 20° C, and then expanded, down to the pressure of 3 atmospheres, through valve VI, passes through duct 4 at a pressure of 3 atmospheres, to exchanger E1 and is discharged from exchanger E1, through duct 5, in the vapor state, at a pressure of 2.5 atmospheres and a temperature of 65° C. From duct 5 the mixture passes first through exchanger E2 wherefrom it is delivered through duct 6, superheated at a temperature of 85° C and at a pressure of 2.2 atmospheres.

The mixture is then compressed to a pressure of 6.6 atmospheres in the compression stage K1 which is driven by a motor whose available power on the driving shaft is 1 MW.

After compression, the gaseous mixture is sent through duct 7 to exchanger E2. It is discharged from exchanger E2 through duct 17 at a temperature of 70° C. In the flask B1, there is recovered a liquid fraction, at a rate of 79 mT/h, which is recycled through duct 16 and pump P1, so adjusted as to maintain a constant level in flask B1. The heat evolved as a result of the partial condensation of the gaseous mixture in exchanger E2, can be used to heat 125 $m^3$/h of water, supplied through duct 8 at a temperature of 65° C and delivered through duct 9 at the temperature of 90° C.

The gaseous mixture formed by uncondensed fraction is supplied through duct 10 to exchanger E3 wherefrom it is delivered through duct 11, superheated to a temperature of 85° C under a pressure of 5.5 atmospheres. It is compressed up to 17 atmospheres in the compression stage K2 which is energized by a motor whose power available on the driving shaft is 554 KW.

After compression, the gaseous mixture is fed through duct 12 to exchanger E3. After condensation, it is delivered from exchanger E3 through duct 13 at a temperature of 70° C, admixed in line with the liquid fraction issued from pump P1 and recycled. By means of the heat of condensation evolved, it is possible to heat 103 $m^3$/h of water introduced through duct 14 at a temperature of 65° C and discharged through duct 15 at a temperature of 90° C.

EXAMPLE 2

Cooling water used for condensation of the vapors discharged from the top of a pentane-removing column of a refinery, is available.

The operating conditions of the cooling have been modified in order to obtain this cooling water at a temperature of 72° C when discharged from the exchanger.

An arrangement identical to that described in FIG. 1 is used to produce hot water for heating buildings.

The water withdrawn from the condenser is supplied to the device through line 1 at a flow rate of 4.9 $m^3$/h. At the outlet of exchanger E1, a pump, not shown on FIG. 1, takes water at 29° C through line 2 and transports it to the condenser of the top of the pentane-removing column.

The heat transferred to the exchanger can be used to vaporize a mixture of hydrocarbons, having the following composition:

38% by weight of propane ($C_3H_8$)

62% by weight of normal pentane ($C_5H_{12}$)

This mixture forms no azeotrope.

Through exchanger E1, there is circulated 2.075 metric tons/h of this mixture which is supplied from duct 3 at the temperature of 75° C under 23.2 absolute bars.

At the outlet of exchanger E1 where the mixture has been subcooled down to 30° C, it is subjected to expansion through valve V1, which results in decreasing its temperature down to 25° C and its pressure to 4.7 bars, while vaporizing 3.5% by weight of the mixture.

The mixture of liquid and vapor is supplied through line 4 to exchanger E1 where it is subjected to total vaporization and delivered through line 5 at 65° C.

The vapors are then passed through exchanger E2 where they are superheated up to 80° C, under a pressure of 4.5 bars. The vapors pass through compressor K1 wherefrom they are delivered through line 7 under a pressure of 10 bars, at 104° C.

Compressor K1 is driven by a motor whose power available on the driving shaft is 26 KW.

The vapors at the outlet of the compressor are partially condensed in E2 and the mixture of liquid and vapor flows through line 17 to flask B1.

The heat of condensation of this mixture has been used to heat 5.2 $m^3$/h of water, supplied through line 8 at 70° C and delivered through line 9 at 90° C. The flow rate of the condensed fraction is 1.25 metric ton/h. This mixture is recycled through pump P1, so adjusted as to maintain a constant level in flask B1. The gaseous mixture, at a flow rate of 825 Kg/h, is conveyed through line 10 to exchanger E3, wherefrom it is delivered through line 11 at the temperature of 90° C under a pressure of 9.8 bars. It is compressed up to 23.4 bars in the compression stage K2 which is driven by a motor having an available power on the shaft of 12.5 KW.

The compressed mixture is conveyed through line 12 to exchanger E3 where it is completely condensed. It is discharged from E3 through line 13 at 75° C, is admixed in line with the liquid fraction issued from pump P1 and then is recycled.

The condensation heat evolved can be used to heat 3.2 $m^3$/h of water supplied at 70° C from line 14 and delivered at 90° C through line 15.

The invention is not limited to the preceding cases and may obviously be applied whenever it is desired to increase the temperature level of heat which can be transferred within a wide temperature range. What we claim is:

1. A process for producing heat comprising: (a) vaporizing a liquid mixture (M) comprising at least two components of different boiling points forming no azeotrope with one another under the vaporization conditions, called working fluid, in a temperature range A above 0° C and below 100° C, by taking at least the major portion of the vaporization heat from a first external fluid acting as heat source, in a countercurrent heat exchange zone I, (b) compressing at least a portion of the obtained vapor in a compression zone, (c) condensing at least a portion of the compressed vapor in a temperature range B above 40° C, while transferring at least the major part of the heat of condensation to a second external fluid in a heat exchange zone II, the highest temperature in the temperature range B being higher than the highest temperature in the temperature range A and, (d) withdrawing at least a portion of the obtained liquid fraction (N), expanding the same and feeding it back to the heat exchange zone I, so as to reconstitute at least a portion of the working fluid (M).

2. A process according to claim 1, wherein the compression and the condensation are performed in several stages, each intermediate compression stage being followed with a partial condensation stage whereby is obtained a liquid fraction (Nn) and a vapor fraction which is fed to the following compression stage, the vapor fraction issued from the last compression stage being entirely condensed and recycled, the totality of the fractions (Nn) being expanded and fed back to the heat exchange zone I.

3. A process according to claim 1, wherein only a portion of the compressed vapor is condensed in the heat exchange zone II, the obtained liquid fraction (N1) is separated from the uncondensed vapor fraction (0), said vapor fraction (0) is compressed and thereafter there is condensed at least a portion of the compressed vapor fraction (0) by heat exchange while transferring heat to an external fluid in a heat exchange zone III, within a temperature range B' defined as the temperature range B, there is withdrawn at least a portion of the obtained liquid fraction ($N_2$) which is expanded and then fed back to the heat exchange zone I so as to constitute an additional portion of the working fluid (M).

4. A process according to one of claim 1, wherein the working fluid comprises at least two hydrocarbons having from 2 to 6 carbon atoms in the molecule.

5. A process according to one of claim 1, wherein the working fluid comprises at least two chlorinated and/or fluorinated hydrocarbons.

6. A process according to one of claim 1, wherein pressure P1, at which the working fluid is vaporized in the heat exchange zone I is from 1 to 10 atmospheres and pressure P2, at which the condensation of the mixture is completed, is from P1 to 50 atmospheres.

7. A process according to one of claim 1, in which the liquid fraction (N) is subcooled before expansion, the subcooling being performed by heat exchange with the working fluid in course of vaporization.

8. A process according to one of claim 1, wherein the vapor discharged from the heat exchange zone I is overheated before compression.

9. A process according to claim 8, in which the overheating of the vapor is performed by heat exchange with the vapor discharged from the compression step.

10. A process according to claim 2, in which each vapor fraction destined to be compressed is overheated, before compression, by heat exchange with the compressed vapor discharged from the compression step.

11. A process according to claim 1, wherein the working fluid contains propane and normal pentane.

12. A process according to claim 1, wherein the heat source is hot water.

13. A process according to claim 1, wherein the heat source is water from a geothermal field.

14. A process according to claim 1, wherein the heat source is water previously used for cooling an industrial unit.

15. A process according to claim 1 wherein the heat source is water heated by solar radiations.

16. A process according to claim 1, wherein at least one of the components of mixture M has a normal boiling temperature higher than 0° C.

17. A process according to claim 2, wherein the working fluid comprises at least two hydrocarbons having from 2 to 6 carbon atoms in the molecule.

18. A process according to claim 2, wherein the working fluid comprises at least two chlorinated and/or fluorinated hydrocarbons.

19. A process according to claim 2, wherein pressure P1, at which the working fluid is vaporized in the heat exchange zone I is from 1 to 10 atmospheres and pressure P2, at which the condensation of the mixture is completed, is from P1 to 50 atmospheres.

20. A process according to claim 2, in which the liquid fractions (Nn) are subcooled before expansion, the subcooling being performed by heat exchange with the working fluid in course of vaporization.

21. A process according to claim 2, wherein at least one of the components of mixture M has a normal boiling temperature higher than 0° C.

* * * * *